US005541027A

United States Patent [19]

Wuelfing, Jr.

[11] Patent Number: 5,541,027

[45] Date of Patent: Jul. 30, 1996

[54] METHOD FOR DETERMINING THE PROPER REPLENISHMENT FOR A DEVELOPING SOLUTION

[75] Inventor: Peter Wuelfing, Jr., Arden, N.C.

[73] Assignee: E. I. Du Pont de Nemours and Comapny, Wilmington, Del.

[21] Appl. No.: 355,790

[22] Filed: Dec. 14, 1994

Related U.S. Application Data

[63] Continuation-in-part of Ser. No. 168,422, Dec. 22, 1993, abandoned, which is a continuation-in-part of Ser. No. 21,542, Feb. 24, 1993, abandoned.

[51] Int. Cl.[6] ..... G03C 5/00; G03C 5/18; G03C 5/26; G03C 3/00

[52] U.S. Cl. ..... 430/30; 430/398; 430/399; 430/435; 430/440

[58] Field of Search ..... 430/30, 398, 399, 430/435, 489, 490

[56] References Cited

U.S. PATENT DOCUMENTS

| | | | |
|---|---|---|---|
| 3,529,529 | 9/1970 | Schumacher | 95/89 |
| 3,822,723 | 7/1974 | Crowell et al. | 222/76 |
| 3,828,172 | 8/1974 | Schickler | 95/89 R |
| 3,870,479 | 3/1975 | Kubotera et al. | 96/29 |
| 3,970,457 | 7/1976 | Parsonage | 96/50 |
| 4,365,895 | 12/1982 | Shaber et al. | 356/444 |
| 4,741,991 | 5/1988 | Wuelfing, Jr. | 430/399 |
| 4,828,968 | 5/1989 | Okutsu | 430/398 |
| 4,882,246 | 11/1989 | Ohba et al. | 430/30 |
| 4,977,067 | 12/1990 | Yoshikawa et al. | 430/398 |
| 5,068,167 | 11/1991 | Hall | 430/264 |
| 5,098,819 | 3/1992 | Knapp | 430/436 |
| 5,212,098 | 5/1993 | Hoffmann et al. | 436/125 |
| 5,252,439 | 10/1993 | Nakamura | 430/399 |

FOREIGN PATENT DOCUMENTS

| | | | |
|---|---|---|---|
| 765994 | 9/1971 | Belgium . | |
| 1572094 | 1/1970 | Germany | 430/399 |
| 2004893 | 8/1971 | Germany | 430/399 |
| 54-37731 | 3/1979 | Japan | 430/30 |
| 55-89834 | 7/1980 | Japan | 430/399 |
| 56-92537 | 7/1981 | Japan . | |
| 83-08884 | 5/1983 | Japan . | |
| 61-259248 | 11/1986 | Japan . | |
| 1313796 | 4/1973 | United Kingdom . | |
| 1439502 | 6/1976 | United Kingdom . | |

OTHER PUBLICATIONS

Crowell et al., U.S. Patent Reissue 30, 123, Oct. 23, 1979.

*Primary Examiner*—Charles L. Bowers, Jr.
*Assistant Examiner*—J. Pasterczyk

[57] ABSTRACT

A method is disclosed in converting silver halide to silver by use of a developer containing two compounds which can be titrated in a single potentiometric titration with silver nitrate and based on the titration an additional quantity of the two compounds are added to depleted developer.

11 Claims, No Drawings

METHOD FOR DETERMINING THE PROPER REPLENISHMENT FOR A DEVELOPING SOLUTION

RELATED APPLICATION

The present patent application is a continuation-in-part of Ser. No. 08/168,422 filed Dec. 22, 1993 now abandoned, which in turn is a continuation-in-part of Ser. No. 08/021,542 filed Feb. 24, 1993, now abandoned.

FIELD OF THE INVENTION

This invention is related to chemical processing of photographic film. More specifically this invention is related to improved processing mixtures, and a diagnostic test therefore, which allows for accurate determination of replenishment and which provides a method for diagnosing improper replenishment.

BACKGROUND OF THE INVENTION

In the photographic process, an image-wise exposed film must be processed to convert the latent image into a viewable negative of the image. The processing operation requires a development step, wherein the exposed silver halide crystals are reduced to elemental silver, and a fix or bleach step wherein the unexposed silver halide crystals are removed from the film. It is also advantageous to wash the film prior to drying and viewing.

Development is accomplished by the reduction of exposed silver halide to silver metal. When hydroquinone, or an equivalent, is used as the reducing agent the reaction which occurs is represented by Equation 1.

$$2AgBr+HO-C_6H_4-OH+Na_2SO_3 \rightarrow 2Ag+HO-C_6H_4-OSO_3Na+HBr+NaBr \quad (1)$$

The active ingredients, hydroquinone and sodium sulfite, are depleted by the silver reduction reaction. Because of the chemical depletions the effectiveness of the processing solution decreases with use. Also occuring is an increase in the bromide level and a decrease in the pH.

Ascorbic acid based developers are also used for reduction of exposed silver halide during development. Analogous depletion of active ingredients is observed with use.

Methods of replenishing the active ingredients are well known in the art and most modern processors are equipped with tanks of replenishment solution and an automatic replenishment mode based on various criteria as known in the art.

Hydroquinone developers are also susceptible to air oxidation. The chemical reaction associated with air oxidation is provided in Equation 2.

$$HO-C_6H_4-OH+2Na_2SO_3+O_2 \rightarrow HO-C_6H_4-O-SO_3Na+Na_2SO_4+NaOH \quad (2)$$

Air oxidation of a hydroquinone developer does not effect the bromide level but the pH increases due to liberation of hydroxide ion as the sodium salt.

Evaporation of water is also known to occur. Loss of solvent can alter the concentration of ingredients and the reactivity. Yet another detrimental phenomenon is the physical removal of developer solution by the film.

Under standard operating conditions decreases in developer activity are expected due to the development reaction, oxidation reaction, solvent evaporation and physical removal. All of these detrimental phenomenon occur, albeit at different rates. When a large amount of film is processed the development reaction is dominant and the problems which must be addressed are decreasing active ingredients, increasing bromide and decreasing pH. When a small amount of film is processed, or for periods of inactivity, the oxidation reaction and solvent evaporation are the dominant concerns.

Monitoring the bromide in the developer is advantageous for suggesting hydroquinone depletion as detailed in U.S. Pat. Nos. 3,529,529 and 3,970,457 yet oxidation is not addressed with this method. In practice these automatic systems are known to fail which is blamed, in part, on the lack of an effective method for standardizing electrodes that are continuously monitored. Monitoring pH is not considered to be effective since competing development and oxidation reactions could balance with no substantial change in pH. Also, most modern developer solutions contain pH buffers which may mask changes. Monitoring both bromide and pH places a burden on the user and is typically neither feasible nor diagnostic.

Specific gravity is another analytical measurement which is often used during the initial makeup of the solutions. The inaccuracy and non-specificity of this method is well known in the art and diagnostic information is rarely obtained.

There has been a long felt need in the art to provide a diagnostic measurement whereby the chemicals and their replenishment can be optimized. Prefered is a single measurement which can provide the diagnositic information.

The prior art also suffers from the lack of diagnostic information provided by the above mentioned measurements. For example, a high bromide ion concentration in the developer would suggest more replenishment chemicals need to be added as described for hydroquinone systems in U.S. Pat. Nos. 3,529,529 and 3,970,457. If oxidation, or evaporation, has occured in the replenishment solution, or if the replenisher is incorrectly prepared the bromide ion concentration alone may provide an inaccurate assessment of developer strength.

The ineffective quantitative means of determining chemical activity has led to the design of indirect methods to determine chemical activity of the developer. The standard method in the art has been to process film and monitor the photographic response as detailed in U.S. Pat. Nos. 5,063,583; 4,508,686 and 4,365,895. A similar approach has been adopted by the American College of Radiology and is manifested in their recommendations for accreditation under the processing section of their Mammography Accreditation Program. These methods are all predicated on the assumptions that:

(a) the film samples are identical and stable with time;

(b) exposure and density readings are invariant;

(c) the developer used at the start of the test is correct; and (d) changes in chemistry will have a predictable, or noticeable, effect on the film. In actual practice all of these assumptions may, and do, fail.

The choice of film is also critical as realized in the art. Films which utilize tabular grains are known to exhibit sensitometric properties which vary with bromide level in the developer. Films with more conventional grains are known to be less sensitive to bromide level but sensitometric differences correlate more strongly to processing temperature and other changes in developer. This places a burden on the health care professional since different films could exhibit different properties in the same processor. To adequately use the indirect method a control film would have to be established for all types of films employed.

A particular deficiency of prior art tests is the lack of information on the activity of the replenisher chemicals. The bromide titration, or indirect film methods, only test the activity of the development solutions in the processor at the time of the test. A single test provides no information about the replenishment conditions. To obtain information on replenishment a subsequent test must be done and the data correlated to analyze for trends and/or the replenisher must be checked independently. Furthermore, a film method is intrusive since the test film itself initiates the development reaction and some replenishment occurs to compensate therefor. Immediately after the control film is processed the conditions in the development solution will be different.

An improperly prepared replenisher may take a considerable amount of time (several hours to several days) to displace a sufficient amount of developer to be observed by a film test. Nominal replenishment rates, as expected for moderate film use, are sufficient to replace approximately half of the chemicals in the developer tank with replenisher chemicals in approximately 8–10 hours. The full effect of incorrect replenishment, either rate or composition, may not be noticed until the developer has been replaced by at least one equal volume of replenisher. This creates a lag time between replenisher preparation, or a change in the rate of addition, and the actual sensitometric effect. The lag time can span several days in some instances. Once an actual problem is detected the entire replenisher and developer must be replaced to correct the situation.

It is not uncommon that specific chemical changes combine with film choice to generate a rapidly deteriorating problem. If the film is particularly sensitive to specific changes in chemistry a deterioration in performance may occur from the time the new replenisher is prepared. The deterioration in performance may not be realized for quite some time, particularly when large batches of film are processed. This problem is especially troublesome in cases such as mammographic exams where mobile units acquire the exposed films and return to a central processing center wherein all of the films are processed prior to being observed.

The tardiness of the test is especially critical if recommended procedures are followed in entirety. Corrective action is suggested only after three consecutive test are observed to generate a trend in any direction away from the norm. Typical test frequency is daily for most situations but the actual time can vary substantially. Therefore, many inferior films could be produced prior to running a control which may lead to an incorrect diagnosis or a need to repeat the exposure to the patient.

Faced with this chemical dilemma and the accepted American College of Radiography guidelines, the practitioner is forced into one of the following two situations. The first is a correct film measurement indicating the current chemistry may be correct but replenishment conditions are unknown. In this situation the practitioner typically continues operating with no knowledge of potential problems. The second situation occurs when the film measurements are not correct. Based on the standard guidelines an initial check of obvious problems such as temperature, and the like, is suggested. If the problem is not resolved the processing and replenishment chemicals are usually discarded and replaced at a substantial financial and time burden to the medical professional.

There is a long felt need in the art to provide means for improved quality control in film processing. There is a further need to provide a developer and replenisher therefore which purposefully contain ingredients that can be accurately and rapidly analyzed to determine the chemical activity of the solution. Described herein is a chemical development method wherein specific ingredients can be added and a potentiometric titration performed to insure proper levels of developer, replenisher, color chromophores and the like.

It is an object of the present invention to provide an improved development method for silver halide films which can be easily monitored and can provide diagnostic information on the activity of the developer.

It is a further object to provide a developer solution, and replenisher therefore, which can provide diagnostic information on the activity of the developer and the replenisher from a single measurement.

It is a further object that the developer/replenisher solution can be monitored independent of the film thereby decreasing the effects of film, exposure and density measurements on the development conditions.

SUMMARY OF THE INVENTION

The present invention is directed to a method of converting a series of exposed silver halide films to viewable images employing a developer which reduces exposed silver halide to elemental silver wherein the concentration of developer is monitored and replenished comprising the steps of:

(a) contacting exposed silver halide film with a developer comprising two compounds wherein the concentration of the two compounds is known prior to said contacting, wherein the concentration of each of the two compounds can be quantitatively determined in a simple potentiometric titration with silver nitrate and wherein the reduction to silver causes depletion of one of the two compounds;

(b) titrating depleted developer which results from reduction of exposed silver halide to silver with silver nitrate with the proviso that only a single titration takes place;

(c) adding an additional quantity of each of said two compounds to depleted developer based on the titration in step (b) resulting in the same concentration of developer compared to an initial developer concentration in step (a); and (d) contacting additional exposed silver halide film with the developer resulting from step (c) to reduce exposed halide film to silver.

In a particularly preferred embodiment the titratably distinct components or compounds are independently defined to have a Ksp between $10^{-6}$ and $10^{-20}$. It is also preferred that the Ksp of the titratably distinct ions differ by at least $10^{-2}$. Particularly preferred as titratably distinct components are bromide and chloride.

DETAILED DESCRIPTION OF THE INVENTION

Chemical developers are specifically formulated to efficiently reduce image-wise exposed silver halide to elemental silver. The developer typically comprises a reducing agent, optional antifoggants, optional pH buffers, optional hardeners and optional stabilizers.

Each of at least two components of an inventive replenisher further comprise compounds which are analytically distinct one from the other when the components are mixed. The term analytically distinct preferably refers to compounds which are titratably distinct.

The term "titratably distinct" refers specifically to compounds which can be quantitatively distinguished in a single potentiometric titration with silver nitrate. The titration should be done at a pH of which is sufficient to insure that silver oxide formation does not occur. This pH is preferably no higher than approximately 8.0.

Preferred titratably distinct components are anions which form silver salts and which do not adversely interfere with the photographic development or fix process. It is particularly important that the silver salts formed are sufficient solubility that premature precipitation does not alter the results. Preferred is a salt with a solubility product (Ksp) of $10^{-6}$ to $10^{-20}$. Specifically preferred are combinations of anions which form silver salts with sufficient differences in solubility product to be quantitatively separatable in a potentiometric titration. In a particularly preferred embodiment the bromide is one titrant and the other titrants are chosen accordingly. Chloride has been found to be particularly preferred as a second titrant due to the low cost, photographic inert properties, solubility and the like.

Preferred reducing agents are hydroquinone, 4-hydroxymethyl-1-phenyl-3-pyrazolidine, 1-phenyl-3-pyrazolidone, or a derivative thereof such as 4-methyl or 4,4-dimethyl-1-phenyl-3-pyrazolidone; hydroquinone or a derivative thereof such as chlorohydroquinone or bromohydroquinone; ascorbic acid; sugar-type derivatives of ascorbic acid; stereoisomers and diastereoisomers of ascorbic acid and their sugar-type derivatives; or salts of ascorbic acid or their derivatives including d-erythro-ascorbic acid (i.e. erythorbic or isoascorbic acid), d-glucosascorbic acid, 6-deoxy-I-ascorbic acid, d-glucoascorbic acid, d-galactoascorbic acid, I-glucoascorbic acid and I-alloascorbic acid.

Exemplary salts of ascorbic acid, which are useful for the teachings herein, include alkali metal salts, such as the sodium and potassium salts thereof (e.g. sodium or potassium ascorbate and sodium or potassium erythorbate).

The unsubstituted compounds of this class of compounds may be represented by the formula:

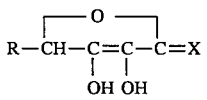

wherein X is an oxygen atom or imino group, R is any group which does not render the ascorbic acid water-insoluble and is a non-interfering group. Non-interfering is defined as not causing steric hindrance, is not chemically reactive with other portions of the molecule, is not a coordination group for the molecule, and is not more electropositive than a saturated hydrocarbon residue. R is preferably an aryl group of 6–10 carbons or a group of the formula $R^1(CH_2)(CH_2)n_{n-1}$ wherein n is a positive integer from 1 to 4 and R1 is either a hydrogen atom or hydroxyl group when n is 2 to 4 and is hydroxyl when n is 1. Of these materials, ascorbic and erythorbic (iso-ascorbic) acid are preferred.

The developer may contain a multitude of conventional ingredients which serve functions well known in the art. Included are additional development agents, antifoggant agents, pH buffers, sequestering agents, swelling control agents, development accelerators, and the like. Materials which may be included in the processing solution, such as swelling control agents (i.e. gelatin hardening agents), aerial oxidation restrainers, sequestering agents, surfactants, dyes, etc., well known in the art are exemplified in U.S. Pat. No. 3,545,971 and *Photographic Processing Chemistry*, L. F. A. Mason, 1966, page 149 et seq.

Other reducing agents which may be used are organic agents such as catechols, aminophenols, phenylenediamines, tetrahydraquinolines, bis(pyridone)amines, cylcoalkenones, pyrimidines, reductones and coumarins. Inorganic development agents may also be mentioned to include metals having at least two distinct valence states and are capable of reducing ionic silver to metallic silver. Such metals include iron, titanium, vanadium and chromium and it is preferable to employ the metals with organic compounds such as polycarboxylic acids or aminopolycarboxylic acids.

The organic antifoggant may be any organic antifoggant or film speed restrainer. Such organic antifoggants are commonly employed in X-ray developer baths and include compounds such as benzimidazole, benzotriazole, benzothiazole, indazole, tetrazole, imidazole, mercaptotetrazole and thiazole group, as well as anthraquinone sulfonic acid salts. Two or more organic antifoggants may be used. It is preferred to use a mixture or two antifoggants such as 5-nitroindazole and benzotriazole. Sodium or potassium bromides are also suitable.

Exemplary sequestering agents include but are not limited to aminopolycarboxylic acid compounds, ethylenediaminetetraacetic acid, and sodium salts thereof, diethylenetriaminepentaacetic acid, diaminopropanoltetraacetic acid, gluconic acid and its salts, hepto and boro-gluconates, citric acid and its salts.

Exemplary swell control agents are dialdehydes or diketones particularly glyoxal, or homologs of glyoxal in which the two aldehyde groups are separated by a chain of 2 or 3 carbon atoms. Preferred is glutaraldehyde. Other compounds which may be mentioned include diacetyl, acetyl benzoyl and dichlorodiacetyl.

It is imperative that a developer pH of approximately 9–12 be maintained. More preferred is a developer pH of approximately 9.7–10.6 and most preferred is a developer pH of 10.0 ±0.3. Any alkaline material may be used to provide the required pH, such as sodium or potassium hydroxide, sodium or potassium carbonate, etc. The buffer system may be any convenient system, e.g., the borate and carbonate buffers conventionally used in X-ray developer baths are quite suitable.

The replenisher solution is ideally formulated such that addition to the developer restores the chemical composition of the developer to optimal composition under steady state conditions. It is typically preferred that the replenisher be substantially identical to the developer with the exception of the titratably distinct additives described herein.

The term Ksp is standard in the art and refers specifically to the solubility product constant. The solubility constant can be defined as the product of the concentration of the ions of a substance in a saturated solution of the substance. For purposes of this invention the solubility product in water, at ambient temperatures, is a sufficiently close approximation to the solubility product in processing chemicals.

If more than two replenisher components are to be monitored then multiple salts can be used with the proviso that at least two meet the criteria described above. Another embodiment includes the use of two salts with at least one salt used in multiple samples. In this embodiment the concentration of salt in the component would be such that when all of the components are added the deviations from ideal concentration would be detectable as shown in Example 1.

The preferred developer composition and replenisher therefore comprises, per liter: 0.5 to 5.0 g. of 1-phenyl-3-pyrazolidone or a derivative thereof; 15 to 35 g. of hydroquinone, or a derivative thereof; 0 to 10 g. of bromide ion; 0.01 to 6.0 mmoles of an organic antifoggant; 1.0 to 30.0 g. of a titratably distinct ion and 0 to 30 g. of a different titratably distinct ion. When bromide ion is present it is preferred that the second titratably distinct ion is chloride.

Another preferred developer composition and replenisher comprises, per liter, 15.0 to 75.0 g. of ascorbic acid; 0.5 to 5.0 g. of 3-pyrazolidone or a suitable derivative thereof; 2 to 20 grams of sulfite; 15 to 30 grams of carbonate; 0 to 10 g. of bromide ion; 0.01 to 6.0 mmoles of an organic antifoggant; 1.0 to 30.0 g. of a titratably distinct ion and 0 to 30.0 g. of a different titratably distinct ion.

One embodiment, in accordance with the teachings herein, is the inclusion of one titratably distinct salt with the reducing agent and one titratably distinct salt with a second replenisher component. Particularly preferred is a composition with one titratably distinct salt added in an amount which is directly proportional to the reducing agent, and the second titratably distinct salt added in an amount which is directly proportional to the glutaraldehyde bisulfite.

It has long been the practice in the art to provide the customer with concentrated solutions which are then mixed prior to use or placed in an automatic mixer as detailed in U.S. Pat. No. 4,741,991. In this embodiment it is particularly preferred that titratably distinct ions be included in each solution. A potentiometric titration can then be used to insure that mixing is accurate prior to replenishing the working developer.

A range of bromide ion can be used successfully in this invention. It is preferred that one of the titratably distinct ions be KBr in an amount equal to 1 to 10 g/liter. NaBr may also be employed. Optimum amounts depend on replenishment rate and specific formula.

These essential ingredients, when dissolved in water at the concentrations set forth above, enable the photographic solution of the invention to function as a developer bath and a shelf-stable replenisher.

Conventionally, all of the ingredients of the developer are prepared in concentrated form in water. Separate portions of the concentrates are furnished users so that interaction between ingredients is lessened while in this concentrated state. Then, the user makes up the developer solution by measuring various amounts from each part and mixing with water to achieve the desired solution. The pH is then adjusted, e.g., to 10.0±0.3, and the solution charged to the processing tank, e.g., of the type described in U.S. Pat. No. 3,545,971, such as an "X-Omat Processor", in the amount required by the system. Development time is determined empirically or by the processor. Replenishment will be carried out at a rate per unit area of exposed film without change in sensitometric properties of the film, and will be determined empirically, as well known. As a guide, when using an X-Omar Processor to process X-ray film, a suitable replenishment rate will be about 50–70 mls per 240 square inches of film (40% exposed) for development to normal radiographic density, using the processing solution of the invention as properly prepared.

Substantially all processors have some type of a standby replenishment mode. There are a lot of differences based on the manufacturer but the concept is usually similar. The standby mode typically works as follows: if no film is passed in a given time, the processor goes into a standby mode which deactivates the drive train and dryer and reduces the water supply. After a given time, it comes back on for several minutes and then shuts off again. After a specified number of cycles, it replenishes a predetermined amount.

Potentiometric titrations are well known in the art as exemplified in Bauer, Christian, O'Reilly, *Instrumental Analysis*, Allyn and Bacon, 1979, Chapter 2.

The following examples are intended to further illustrate and demonstrate the teachings of this invention. These examples are not intended to limit the scope of the claims in any way.

EXAMPLE 1

An example of the use of three components with two salts is as follows: Solution 1 would contain salt A at a level sufficient to equal 4 g/l in the final mixture, Solution 2 would contain salt B at a level sufficient to equal 4 g/l in the final mixture, Solution 3 would contain salt A at a level sufficient to equal 1 g/l and salt B at a level sufficient to equal 1 g/l in the final mixture. A properly prepared replenisher would be expected to contain 5 g/l of both salt A and salt B. If Solution 1 is added incorrectly then salt A will deviate from 5 g/l but salt B will be correct and so forth.

EXAMPLE 2

Three stock solutions were prepared in accordance with U.S. Pat. No. 4,741,991. Sodium chloride was added to Solution C to demonstrate the utility of the current invention. For this example diagnostic analysis is restricted to two solutions only to facilitate understanding of the inventive concept. Expansion to more solutions could be accomplished as detailed in Example 1.

| Ingredients | Amt(g) |
|---|---|
| Solution A | |
| Dist. Water | ca. 3785 |
| EDTA | 75 |
| Sodium Bisulfite | 1428 |
| Hydroquinone | 946 |
| KOH (45% aq.) | 3075 |
| KOH (solid) | 1383 |
| Sodium Bicarbonate | 315 |
| KBr | 113 |
| Dist. Water to | 9.46 liters |
| Solution B | |
| Triethylene Glycol | 402 |
| Acetic Acid | 270 |
| Phenidone | 60 |
| 5-nitroindazole | 6 |
| Benzotriazole | 8 |
| Dist. Water to | 1 liter |
| Solution C | |
| Water | 500 |
| Glutaraldehyde (50% aq.) | 267 |
| Sodium Bisulfite (anhydr.) | 106 |
| Sodium Chloride | 67.56 |
| Dist. Water to | 1 liter |

Specific mixtures of these ingredients were prepared as replenishment solutions which are chosen to simulate actual operating conditions commonly encountered in a processor. This mixture is intended for use with a replenisher which has a constant bromide level of 3.0 g/l , as sodium salt, and a pH of 10.0 ±0.3. The specific solutions are detailed below.

| R1 - representing a properly prepared replenisher solution | |
|---|---|
| Water | 700 mls |
| Solution A | 250 mls |
| Solution B | 25 mls |
| Solution C | 25 mls |
| R2 - representing a replenisher which is 10% overdiluted | |
| Solution R1 | 250 mls |
| Water | 25 mls |
| R3 - representing a replenisher which is 15% overdiluted | |
| Solution R1 | 250 mls |
| Water | 37.5 mls |

-continued

| R4 - representing replenisher with proper dilution but 10% shortage of | |
|---|---|
| Solution A | |
| Water | 725 mls |
| Solution A | 225 mls |
| Solution B | 25 mls |
| Solution C | 25 mls |
| R5 - representing replenisher with proper dilution but 10% shortage of | |
| Solution C | |
| Water | 702.5 mls |
| Solution A | 250 mls |
| Solution B | 25 mls |
| Solution C | 22.5 mls |
| R6 - representing a solution which is properly mixed but underdiluted by | |
| 10% | |
| Water | 600 mls |
| Solution A | 250 mls |
| Solution B | 25 mls |
| Solution C | 25 mls |

Standard pH and specific gravity measurements were taken and the halides were titrated using the following procedure. A 10 ml sample was taken from each solution. The sample was diluted to 120 mls with 0.1N sulfuric acid. The samples were then titrated for bromide ion and chloride ion, in triplicate, using the two endpoint potentiometric method on a Brinkman Model 702 automatic titrator using a silver billet electrode. The halide ion concentration was reported as a sodium salt. The pH was measured with a Fisher Accumet 915 pH meter equipped with a combination glass electrode as known in the art. Specific gravity was determined by weighing 10 ml samples. The results are listed in Table 1.

TABLE 1

| Replenisher | pH | SG | Br | Cl |
|---|---|---|---|---|
| R1 | 10.10 | 1.81 | 3.05 | 1.69 |
| R2 | 10.10 | 1.72 | 2.81 | 1.51 |
| R3 | 10.11 | 1.71 | 2.68 | 1.46 |
| R4 | 10.02 | 1.72 | 2.75 | 1.69 |
| R5 | 10.13 | 1.79 | 3.02 | 1.55 |
| R6 | 10.16 | 1.90 | 3.42 | 2.00 |

SG is specific gravity in g/l, Br and Cl are both in g/l as sodium salt.

Expected values for pH are 10.1±0.1 which suggest that all of these solutions are within the normal operating range and are therefore considered acceptable for use even though they were purposely prepared incorrectly.

Except for the sodium chloride, the replenisher illustrated is substantially identical to that described in U.S. Pat. No. 4,741,991. This replenisher is intended to be used with a developer which has a steady state bromide level of approximately 6.0 to 7.0 g/l as the sodium salt. As expected the development reaction would cause the bromide ion level to increase as film is developed in accordance with Equation 1. The combined teachings of U.S. Pat. No. 4,741,991 and U.S. Pat. No. 3,970,457 would suggest that the replenisher is added in an amount sufficient to return the bromide ion level to the predetermined level. Addition of a replenisher with a bromide ion level of approximately 3.0 g/l as the sodium salt would effectively dilute the bromide ion concentration thereby counteracting the effect of use as described herein. Using only a bromide ion titration on the developer, and a replenisher with an expected bromide level of 3.0 g/l as the sodium salt, the replenishment for each sample would yield different results. The developer replenished with R2, R3 or R4 would be under replenished since not as much solution would be required to lower the bromide ion concentration to a predetermined level. Even though the bromide ion level would be corrected the $HOC_6H_4OSO_3Na$ would not be replaced with unreacted hydroquinone and sulfite. Therefore, a continuous bromide ion titration on the developer would not offer any diagnostic information. The developer replenished with R5 would have the proper amount of hydroquinone added but would be deficient of sulfite and glutaraldehyde. The deficiency in sulfite and glutaraldehyde would be completely transparant from the bromide ion titration alone. The developer replenished with R6 would also be incorrectly replenished since the bromide ion concentration added to the developer would be higher, on a volume basis, than expected.

Depending on the film used a processor upset may be detected for each of R2 through R6 with no diagnostic information available based on the bromide ion titration alone.

Using identical solutions and analyzing both the bromide and chloride ion solutions, in accordance with this invention, provides an immediate indication of improper mixing. The four distinct possibilities which exist for the replenisher in this example are:

(1) both halide ions are on aim (i.e. R1)

(2) both halides are either above or below aim (i.e. R2, R3, R6)

(3) one halide ion is high and the other is low (4) one halide ion is off aim or missing (i.e. R4, R5).

A titration of the developer replenished with R 1 would have the predetermined level of bromide ion and chloride ion. A titration of the developer replenished with a set amount of R2 or R3 would have a bromide ion level which is lower than the predetermined level and a chloride ion level which is below the predetermined level. A developer replenished with a set amount of R4 would have a bromide ion level which is lower than the predetermined level and a chloride ion level which is at the predetermined level. A developer replenished with a set amount of R5 would have a bromide ion level which is at the predetermined level and a chloride ion level which is low. A developer replenished with a set amount of R6 would have a bromide and chloride level which is above the predetermined levels. In all cases the incorrect solution could be immediately corrected by changing replenishment amount or adding one component of replenisher.

These diagnostics could then be used to properly adjust the solutions and/or the replenishment rate to achieve the appropriate results. Based on these examples the replenishment rate could be increased by the appropriate factor when samples such as R2 and R3 are observed. R4 and R5 could be remixed with additional ingrediants to achieve the proper balance of bromide ion to chloride ion and the replenishment adjusted accordingly. R6 could be diluted to the appropriate level and the problem alleviated. In each of these examples the current practice of replacing the entire chemical charge and remixing could be avoided since the mixture could be corrected.

Furthermore, once the above mentioned corrections are made a retest can be used to certify that the replenishment, and development are correct without the use of film.

What is claimed is:

1. A method for converting a series of exposed light sensitive silver halide films to viewable negative images employing a developing solution comprising a developing agent which reduces exposed silver halide to elemental silver wherein said elemental silver forms a viewable negative image and the concentration of said developing agent in said developing solution is monitored and replenished comprising the steps of:

(a) contacting exposed silver halide film with said developing solution comprising two compounds chosen from the group consisting of salts of bromide ions and salts of chloride ions wherein the concentration of the two compounds is known prior to said contacting, wherein the concentration of each of the two compounds can be quantitatively determined in a simple potentiometric titration with silver nitrate and wherein the reduction to silver causes a change in concentration of one of the two compounds thereby forming a depleted developer solution;

(b) titrating said depleted developing solution which results from reduction of exposed silver halide to silver with silver nitrate with the proviso that only a single titration takes place;

(c) adding an additional quantity of a replenishing solution comprising said developing agent and each of said two compounds to depleted developing solution based on the titration in step (b) resulting in the same concentration of said developing agent in said developing solution compared to an initial concentration of said developing agent in said developing solution in step (a); and (d) contacting additional exposed silver halide film with said developing solution resulting from step (c) to reduce additional exposed light-sensitive silver halide of said additional exposed silver halide film to silver;

with the proviso that the concentration of one of said two compounds does not change during said contacting or said adding of said replenishing solution and said exposed silver halide is selected from the group consisting of silver bromide, silver chloride, and silver iodobromide.

2. The method recited in claim 1 wherein said compounds independently form silver salts with a Ksp value between $10^{-6}$ and $10^{-20}$.

3. The method recited in claim 1 wherein one of said two compounds forms bromide ions in said developing solution.

4. The method recited in claim 1 wherein one of said two compounds forms chloride ions in said developing solution.

5. The method recited in claim 1 wherein said developing solution contains at least one developing agent chosen from the group consisting of 4-hydroxymethyl-1-phenyl-3-pyrazolidone, 1-phenyl-3-pyrazolidone, 4-methyl-1-phenyl-3-pyrazolidone, 4,4-dimethyl-1-phenyl-3-pyrazolidone, hydroquinone, chlorohydroquinone, and bromohydroquinone.

6. The method recited in claim 1 wherein said developing solution comprises at least one developing agent chosen from the group consisting of:

(a) ascorbic acid;

(b) sugar derivative of ascorbic acid;

(c) stereoisomer of ascorbic acid;

(d) diastereoisomer of ascorbic acid; and (e) salt of ascorbic acid.

7. The method recited in claim 1 wherein said developing solution comprises at least one developing agent chosen from the group consisting of ascorbic acid, d-erythro-ascorbic acid, 6-deoxy-1-ascorbic acid, d-glucoascorbic acid, d-galactoascorbic acid, 1-glucoascorbic acid and 1-alloascorbic acid.

8. The method recited in claim 1 wherein said developing solution comprises:

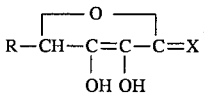

wherein:

X is an oxygen atom or imino group;

R is an aryl group or a group of the formula $$R^1CH_2(CH_2)_{n-1}$$

wherein n is a positive integer from 1 to 4 and $R^1$ is either a hydrogen atom or hydroxyl group when n is 2 to 4 and is hydroxyl when n is 1.

9. The method recited in claim 1 wherein said developing agent comprises an ascorbic acid compound of formula:

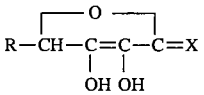

wherein:

X is an oxygen atom or imino group;

R is any group which does not render the ascorbic acid water-insoluble and is a non-interfering group.

10. A method for converting a series of image-wise exposed light sensitive silver bromide photographic films to viewable negative images comprising the steps of:

(a) developing an image-wise exposed silver bromide film in a developing solution containing a developing agent and bromide and chloride ions in a first concentration ratio, wherein the exposed silver bromide is reduced: to elemental silver, said elemental silver forms said viewable negative image and the concentration of the bromide ions in the developing solution is increased and the concentration of chloride ions in the developer remains the same so that the activity of the developing solution is depleted thereby forming a depleted developing solution;

(b) removing the unexposed silver bromide from said photographic film resulting in a viewable negative image;

(c) titrating the depleted developing solution by use of silver nitrate to determine the ratio of bromide ion to chloride ion in the depleted developing solution;

(d) adding a replenishment solution comprising bromide ions and chloride ions and said developing agent to the depleted developing solution in an amount sufficient to return the ratio of bromide ions to chloride ions to the first concentration ratio of bromide ions and chloride ions; and (e) repeating steps (a) through (d) for at least one additional image-wise exposed silver bromide film.

11. The method of claim 1 wherein said exposed silver halide is silver bromide or silver chloride.

* * * * *